United States Patent [19]

Takemura et al.

[11] 4,271,983

[45] Jun. 9, 1981

[54] LIQUID-WITHDRAWING DEVICE

[75] Inventors: Nobuyuki Takemura, Nishinomiya; Ichiro Fukuchi, Takatsuki, both of Japan

[73] Assignee: Toppan Printing Co., Ltd., Tokyo, Japan

[21] Appl. No.: 903,920

[22] Filed: May 8, 1978

[30] Foreign Application Priority Data

May 16, 1977 [JP] Japan ..... 52-62477[U]
May 16, 1977 [JP] Japan ..... 52-62478[U]
Aug. 2, 1977 [JP] Japan ..... 52-103727[U]

[51] Int. Cl.[3] ..... B65D 5/74

[52] U.S. Cl. ..... 222/85; 222/86; 222/89; 222/484

[58] Field of Search ..... 222/85, 89, 81, 567, 222/80, 86, 88

[56] References Cited

U.S. PATENT DOCUMENTS

| | | | |
|---|---|---|---|
| 1,279,667 | 9/1918 | Davis | 222/85 UX |
| 1,293,522 | 2/1919 | O'Callaghan | 222/89 |
| 3,059,816 | 10/1962 | Goldstein | 222/543 X |
| 3,131,831 | 5/1964 | Dorchak | 222/86 |
| 3,143,248 | 8/1964 | Branda | 222/81 |
| 3,285,472 | 11/1966 | Olson | 222/86 |
| 3,549,049 | 12/1970 | Weber | 222/91 |
| 3,721,370 | 3/1973 | Blum | 222/567 X |

FOREIGN PATENT DOCUMENTS

| | | | |
|---|---|---|---|
| 2609722 | 9/1976 | Fed. Rep. of Germany | 222/86 |
| 1417397 | 12/1975 | United Kingdom | 222/89 |

*Primary Examiner*—David A. Scherbel
*Assistant Examiner*—Frederick R. Handren

[57] ABSTRACT

A device for withdrawing liquid from a paper container having the upper wall provided with a fin-shaped projection, comprising a groove portion adapted to be engaged with the fin-shaped projection of the paper container and at least one hollow body formed on one side of the groove portion, said hollow body having a sharp edge portion which is inserted through the paper wall into the container and an open head for withdrawing the liquid housed in the paper container.

4 Claims, 10 Drawing Figures

LIQUID-WITHDRAWING DEVICE

BACKGROUND OF THE INVENTION

This invention relates to a device for withdrawing liquid from a paper container.

Recently, a hollow body having openings at both ends has been used as a device for withdrawing drinking water or the like housed in, for example, a parallelepiped paper container. Namely, one end portion of the hollow cylindrical body is screwed in the upper wall of the paper container and the liquid housed in the container is withdrawn through the opening at the other end. The device of this type is defective in that the liquid housed in the container permeates into the paper wall through the cross section thereof as the hole drilled by the insertion of the end portion of the body. Naturally, the permeation of the liquid causes the paper wall to swell and soften, resulting in loosening of the liquid withdrawing device mounted to the paper container if the liquid is withdrawn repeatedly over a long period of time. It follows that the liquid housed in the paper container tends to leak outside and the withdrawing device is likely to be detached. In addition, broken pieces of the paper wall tend to enter the container when the withdrawing device is screwed in the paper wall.

SUMMARY OF THE INVENTION

An object of this invention is to provide a liquid-withdrawing device free from the above-noted drawbacks inherent in the conventional device. Namely, this invention is intended to provide a liquid-withdrawing device free from the loosening problem even after repeated withdrawal of the liquid from the container, and capable of preventing broken pieces of the paper wall from entering the container when the device is inserted through the paper wall.

According to this invention, there is provided a device for withdrawing liquid from a paper container having the upper wall provided with a fin-shaped projection, the device having a groove portion adapted to be engaged with the fin-shaped projection of the paper container and at least one hollow body formed on one side of the groove portion, said hollow body having a sharp edge portion for inserting through the paper wall into the container and an open head for withdrawing the liquid housed in the paper container.

DETAILED DESCRIPTION OF THE INVENTION

Figure 1:
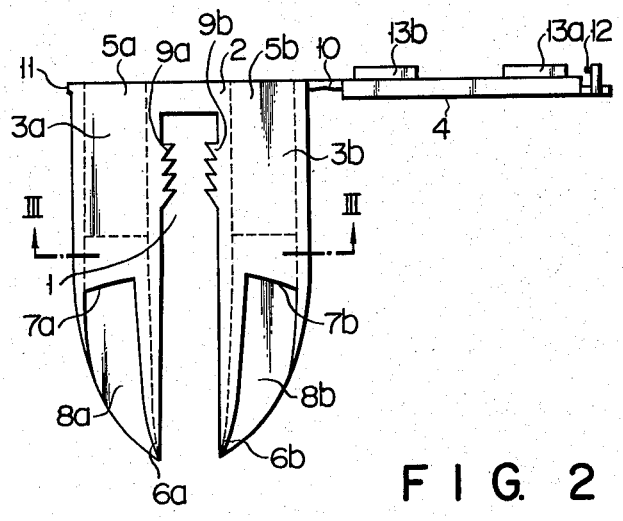
FIG. 1 is a side view showing a liquid withdrawing device according to one embodiment of this invention.
Figure 2:
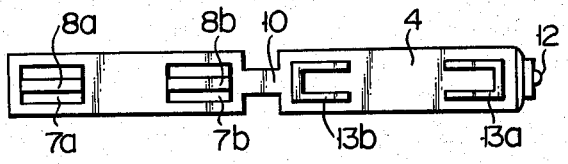
FIG. 2 is a plan view of the liquid withdrawing device shown in FIG. 1.
Figure 3:
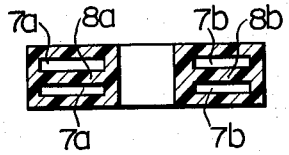
FIG. 3 is a cross sectional view along the line III—III of FIG. 1.
Figure 4:
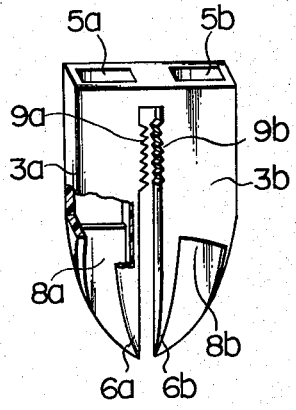
FIG. 4 is a perspective view, partly broken away, of the device shown in FIG. 1.

As shown in FIGS. 1 to 4, a liquid-withdrawing device of this invention comprises a pair of hollow bodies 3*a*, 3*b* of the same construction, a bridge member 2 bridging the bodies 3*a*, 3*b* disposed apart in parallel from each other, and a lid 4 covering the open heads 5*a*, 5*b* of the bodies 3*a*, 3*b*. It is seen that the bodies are each rectangular in cross section and are suitably spaced apart from each other so as to provide a groove portion 1 therebetween. The open heads 5*a*, 5*b* of the bodies 3*a*, 3*b* act as the outlet port for the liquid or the inlet port for air. The bodies 3*a*, 3*b* are inwardly tapered to provide sharp edges 6*a*, 6*b*, respectively, for piercing through the paper wall of the container. Further, these bodies are cut aslant near the sharp edges 6*a*, 6*b* so as to provide openings 7*a*, 7*b*.

On the lower part of the bodies 3*a*, 3*b* are provided reinforcing partition walls 8*a*, 8*b* in a manner to separate the fluid passageways through the openings 7*a*, 7*b* into two sections, and to form a tapered edge extending to the sharp edge, respectively so as to increase the mechanical strength of the bodies at the edge portions including the sharp edges 6*a*, 6*b*. It is preferable that tooth-shaped projections 9*a*, 9*b* are formed to face each other at those walls of the bodies 3*a*, 3*b* which define the groove portion 1. As described later, these projections 9*a*, 9*b* serve to ensure a stable engagement of the groove portion with a fin-shaped projection of the paper container. Accordingly, the projections may be shaped to resist disengagement of the liquid-withdrawing device from the paper container, if necessary, for example, in the shape of sawteeth as shown in the drawings, though projections of an optional shape may serve the aimed purpose in general.

The lid 4 is swingably mounted to the upper right-hand edge of the body 3*b* by means of a hinge 10. An engagement member 12 provided at the tip of the lid 4 is engaged with a projection 11 provided at the upper left-hand edge of the body 3*a*, when the lid 4 is swung to cover the open heads of the bodies. The lid 4 is also provided with projections 13*a*, 13*b* to engage with the inner walls of the bodies at the open heads 5*a*, 5*b* of the liquid-withdrawing device.

Figure 5:
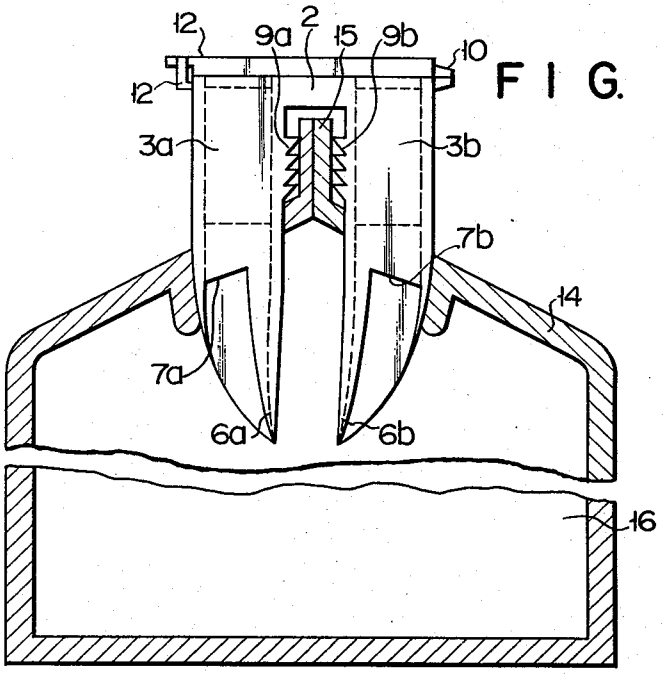

FIG. 5 shows how to mount the liquid-withdrawing device of the above-described construction to a paper container 16 having a roof-shaped tapering upper wall 14 and a fin-shaped projection 15. As shown in the drawing, the bodies 3*a*, 3*b* are disposed to sandwich the fin-shaped projection 15 of the container and pushed downward where the sharp edges 6*a*, 6*b* of the bodies to pierce through the upper wall 14 of the paper container. In this case, the bodies should be sufficiently inserted to permit the openings 7*a*, 7*b* thereof to be positioned completely inside the paper container 16. If the paper container is tilted, the liquid housed in the container is withdrawn from one of the open heads of the bodies 3*a*, 3*b*, with the other head acting as an air inlet port.

The liquid-withdrawing device of this invention is applicable to a paper container having a tapering or flat upper wall and a fin-shaped projection mounted to the upper wall, or to a paper container of a similar structure.

Figure 6:
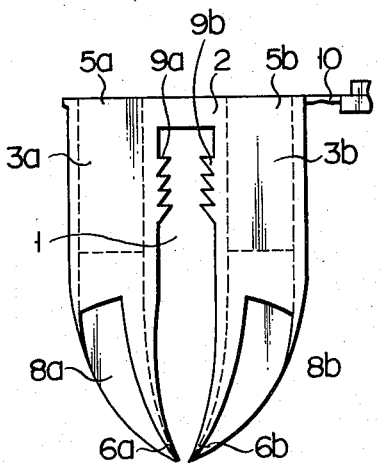
FIG. 6 is a side view of the device showing another embodiment of this invention.

FIG. 6 shows a modification of the device shown in FIG. 1. In this embodiment, the tip portions of the bodies 3*a*, 3*b* are moderately curved to approach each other like a bill of bird, so as to facilitate the piercing of the tip portions through the tapering upper wall 14 of the paper container 16.

In the above embodiments, both of the bodies 3*a*, 3*b* are selected to be of the same shape and size and are provided diametrically. However, various modifications are possible according to this invention.

Figure 7:
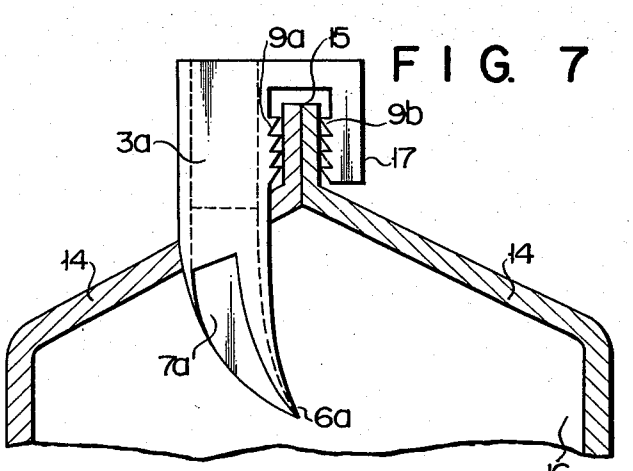
FIGS. 5 and 7 are side views each showing how the device according to another embodiment of this invention is mounted to a paper container for withdrawing the liquid housed in said container.
Figure 8:
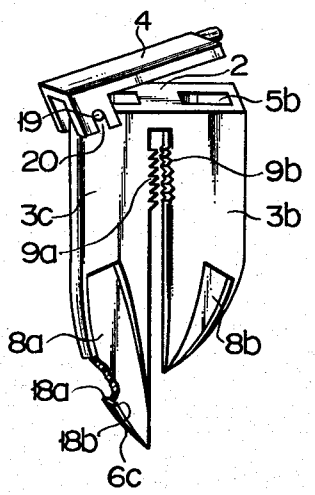
FIG. 8 is a perspective view, partly broken away, of the device according to still another embodiment of this invention.
Figure 9:
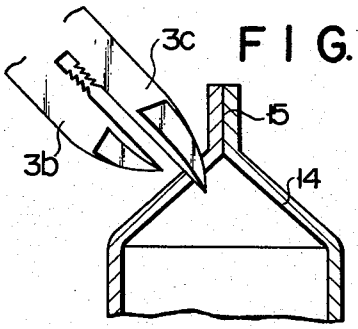
FIGS. 9 and 10 are side views each showing how the device of FIG. 8 is used when it is mounted to a paper container for withdrawing the liquid therefrom.
Figure 10:
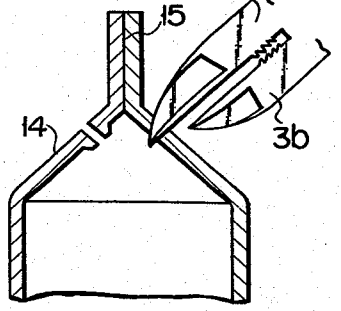

FIGS. 7 and 8 show additional embodiments of this invention. In the embodiment of FIG. 7, the body 3*b* shown in the preceding embodiments is replaced by a clamp member 17. On the other hand, a body 3*c* is made longer than the body 3*b* in the embodiment of FIG. 8. The latter construction is effective for facilitating the piercing operation of the device through the upper wall of the paper container. Specifically, a sharp edge 6*c* of the longer body 3*c* can be used for perforating in advance predetermined portions of the upper wall 14 of the container near the fin-shaped projection 15 as shown in FIGS. 9 and 10. Naturally, the construction of FIG. 8 is effective where the paper forming the container is unduly rigid.

In the embodiments described above, the bodies 3*a*, 3*b* are rectangular in cross section. But, the cross sectional shapes of the bodies can be made circular, triangular, polygonal, pentagrammatic, etc., as well. Further, tapered ribs 18*a*, 18*b* may be provided an each of the partition walls 18*a*, 18*b* used for reinforcing the bodies, as shown in FIG. 8. Of course, these tapered collars further improve the mechanical strength of the bodies.

Material suitable for forming the bodies 3*a*, 3*b* include, for example, metals and relatively rigid thermoplastic resins like polypropylene, polystyrene and acrylonitrile-styrene copolymer.

The construction of the lid 4 covering the open heads of the bodies need not be restricted to that shown in FIG. 1. For example, the lid 4 may be provided with wings downwardly extending from one end portion. In this case, grooves 20 are formed in the wings and swingably engaged with a pair of projections 19 outwardly extending from upper left portion of the body 3*c* as shown in FIG. 8. Incidentally, the lid 4 may be omitted in some cases.

As described in detail, the liquid-withdrawing device of this invention makes it possible to provide an outlet to a paper container by merely inserting the hollow bodies through the upper wall thereof in a manner to sandwich a fin-shaped projection mounted to the upper wall of the container. It is important to note that the sharp edge portions of the bodies are inwardly tapered, resulting in that the stresses on the bodies in the insertion step are exerted in a direction to press the fin-shaped projection from both sides thereof toward fin 15. Namely, the tapering serves to prevent the bodies from getting unduly apart from each other and facilitates the insertion of the bodies into the container. Further, the particular construction of this invention prevents the broken pieces of the paper wall from entering the container. Particularly, the outer walls of the hollow bodies are tightly pressed against the paper wall under the inserted state of the liquid-withdrawing device. Naturally, the device of this invention is advantageous in sanitary point of view, too. What is also important is that the liquid-withdrawing device can be kept stably mounted to the paper container even if the liquid housed in the container is withdrawn repeatedly over a long period of time because the fin-shaped projection of the container is held between the two bodies. The effect mentioned can be enhanced if tooth-shaped projections are formed on those walls of the bodies which define the groove adapted to be engaged with the fin-shaped projection of the paper container. Further, one of the two open heads of the bodies provides an air inlet port while the liquid housed in the container is withdrawn through the open head of the other body, leading to a smooth outflow of the liquid. Further, the lid covering the open heads of the bodies prevents dusts suspended in the air from entering the container, rendering it possible to keep clear the liquid housed in the container.

What is claimed is:

1. A device for withdrawing liquid from a paper container having an upper wall provided with a fin-shaped projection, said device comprising:

a pair of parallel hollow tubular bodies connected to each other at adjacent ends thereof, forming therebetween a grooved portion having inwardly directed tooth-shaped projections adapted to be engaged with the fin-shaped projection of the paper container;

one of said hollow bodies having an open head for withdrawing the liquid housed in the paper container, the other having an open head for venting air into the container; and a partition wall serving to reinforce each hollow body provided in the free end portion of the hollow body in a manner to separate the interior thereof into two sections, the end of said partition wall at the end of the hollow body being formed into a sharp edge portion tapered from outside toward the grooved portion for piercing through the upper wall portion of a container adjacent the fin-shaped projection.

2. The device according to claim 1, wherein one of the two cylindrical bodies is longer than the other.

3. The device according to claim 1, wherein the free end portions of the hollow bodies are bent toward the center of the groove portion.

4. The device according to claim 1, wherein a lid is swingably mounted to close the open heads of the hollow bodies.

* * * * *